United States Patent [19]

Verberne

[11] Patent Number: 4,776,898

[45] Date of Patent: Oct. 11, 1988

[54] PASSIVATION

[75] Inventor: Wim M. J. C. Verberne, 's-Hertogenbosch, Netherlands

[73] Assignee: OMI International Corporation, Warren, Mich.

[21] Appl. No.: 840,806

[22] Filed: Mar. 18, 1986

[30] Foreign Application Priority Data

Mar. 20, 1985 [GB] United Kingdom ..... 8507181

[51] Int. Cl.[4] ..... C23C 22/24

[52] U.S. Cl. ..... 148/6.21

[58] Field of Search ..... 148/6.1, 6.21

[56] References Cited

U.S. PATENT DOCUMENTS

| | | | |
|---|---|---|---|
| 1,967,715 | 7/1934 | Magruder | 148/6.2 |
| 2,288,007 | 6/1942 | Lum | 148/6.21 |
| 2,357,219 | 8/1944 | Mott | 148/6.2 |
| 2,502,476 | 4/1950 | Ott | 148/6.2 |
| 3,130,085 | 3/1964 | Otto | 148/6.2 |
| 3,405,014 | 10/1968 | Kuwabara | 148/6.21 |
| 3,447,972 | 6/1969 | Wilde | 148/6.2 |
| 4,591,416 | 5/1986 | Kamitani | 148/6.21 |

FOREIGN PATENT DOCUMENTS

| | | | |
|---|---|---|---|
| 0185777 | 10/1983 | Japan | 148/6.2 |
| 974800 | 11/1964 | United Kingdom | 148/6.2 |

*Primary Examiner*—Sam Silverberg

*Attorney, Agent, or Firm*—Richard P. Mueller

[57] ABSTRACT

A method of passivating a zinc-cobalt alloy, which alloy has a cobalt content of 0.1–2%, by contacting the alloy with an aqueous composition which has a pH of 0.5–2.5 and contains hexavalent chromium, hydrogen ions to provide the pH, chloride ions and sulfate ions and which may also contain nickel and/or cobalt ions.

10 Claims, No Drawings

PASSIVATION

This invention relates to the passivation of alloys of cobalt and zinc.

Zinc has long been used to plate various base metals, including steel and copper, for the purpose of enhancing both functional and decorative characteristics of the metal. Further to improve the characteristics of the surface coating, in particular the corrosion resistance of the zinc itself, the deposit has frequently been passivated, that is to say treated with a composition to induce the deposition of various protective metal salts on the surface of the zinc.

Passivating compositions for zinc deposits are known and are generally based on hexavalent chromium. Among the known compositions are those leading to the formation of a yellow passivate on the zinc deposit.

Recently, it has come to be appreciated that many if not all of the benefits of zinc plating together with the additional benefit of improved corrosion resistance can be obtained by plating a zinc-cobalt alloy instead of pure zinc. A process for plating such an alloy is disclosed in No. GB-A-2116588. The superiority of zinc-cobalt alloy deposits over pure zinc deposits is further enhanced by passivating them. Conventional chromate-based yellow passivating compositions for pure zinc do work on zinc-cobalt alloy deposits, but generally do not offer such a marked improvement over the unpassivated plate as is observed when the passivating composition is used on pure zinc.

There is therefore a need for a passivating composition for use on zinc-cobalt alloys which gives a good improvement in corrosion protection properties over the unpassivated deposit. No. GB-A-2113721 discloses a bath for forming coloured chromate films on zinc-nickel alloys, but compositions as disclosed in this prior patent application have not been found to be sufficiently effective on zinc-cobalt alloys.

According to a first aspect of the invention, there is provided an aqueous composition for passivating zinc-cobalt alloys, the composition (a) a source of hexavalent chromium, (b) hydrogen ions to provide an acid pH, (c) a source of chloride ions, (d) a source of sulphate ions, and (e) in addition to or instead of ingredient (d) a source of nickel and/or cobalt ions.

The source of hexavalent chromium will normally be a chromate, preferably chromic acid itself, which may be added as chromic anhydride. Dichromate could be used alternatively or in addition. A concentration of chromium (VI) will generally range from 0.01M to 1M, with concentrations in the range of from 0.02M to 0.07M being preferred and 0.05M being typical.

The pH will generally range from 0.5 to 2.5, with a pH in the range of from 1 to 2 being preferred and a pH of 1.5±0.1 being typical.

The source of chloride ions can be any non-interfering salt, but it is preferred that the source of chloride ions be a Group IIa metal salt, such as magnesium chloride, or a Group Ia metal salt, such as sodium chloride or potassium chloride, or ammonium chloride. A mixture of more than one chloride salt may be present. The chloride concentration will generally range from 0.01M to 0.5M, with concentrations in the range of from 0.02M to 0.2M being preferred and 0.07±0.02M being typical.

The source of sulphate ions may also be any non-interfering salt. Ammonium sulphate and Group Ia metal sulphates have been found to be acceptable. Particularly good results, however, have been noted with the use of cobalt sulphate and nickel sulphate, of which nickel sulphate appears to give the best results. The concentration of sulphate ions will generally range from 1 mM to 25 mM, with concentrations in the range of from 2 to 20 mM being preferred and 7±2 mM being typical.

Compositions in accordance with the invention may include sulphate ions and be free of nickel and cobalt ions; or they may include nickel and/or cobalt ions and be free of sulphate ions; but most of all it is preferred that they contain on the one hand sulphate ions and on the other hand nickel and/or cobalt ions. The sulphate ions and the nickel and/or cobalt ions may be conveniently provided by nickel sulphate and/or cobalt sulphate.

The concentration of nickel or cobalt ions, taken separately or combined, may generally range from 1 mM to 25 mM, with concentrations in the range of from 2 to 20 mM being preferred and 7±2 mM being typical.

It will therefore be seen that the invention extends in one embodiment to an aqueous composition for passivating zinc-cobalt alloys, the composition comprising a source of hexavalent chromium, hydrogen ions to provide an acid pH, a source of chloride ions, a source of sulphate ions and a source of nickel and/or cobalt ions.

Preferred compositions in accordance with the invention may also contain one or more optional additives. Such optional additives may already be known in the art and may be anions used to regulate the depth of colour, the hardness of the film, the thickness of the film and/or the adhesion of the film. As examples: nitrate and nitrite ions impart a lightness to the colour; sulphamates impart clarity to the film and depth to the colour; formates and acetates can affect the colour of the film; borates may improve film adhesion; and phosphates may improve the hardness of the film. Such anions, when present, may be present in concentrations ranging from the lowest level at which they are effective up to saturation or, if lower, the limit of their compatibility with the composition.

The concentration of formate anions, when present, may typically but not necessarily range from 0.1 to 14 g/l (2.2 mM to 0.3M); that of nitrate ions (when present) may range from 0.1 to 10 g/l (1.6 mM to 0.16M); that of acetate ions (when present) may range from 0.1 to 12 g/l (1.7 mM to 0.20M); that of sulphamate ions (when present) may range from 0.1 to 8 g/l (1.1 mM to 84 mM); that of borate ions (when present) may range from 0.1 to 40 g/l (1.7 mM to 0.68 mM); and that of phosphate ions (when present) may range from 0.1 to 12 g/l (1.1 mM to 0.13M).

The cations of compounds containing the above anions may be hydrogen group IA or group IIA metals or nickel or cobalt. Such compounds are not essential for the functioning of the bath but may be used to give special effects.

Zinc and/or trivalent chromium ions may also be added to the composition in amounts sufficient to aid in initially forming the desired passivate coating. These ions, when included at all, need only be present in small amounts, for example from 0.1 to 1 g/l.

It may be found that in some circumstances the addition compounds containing certain of the above anions may be found to have unwanted effects. For example, the addition of nitrates may lead to black spotting. But this may not be a disadvantage, for example when a black passivate is being produced. If the use of an optional additive would lead to disadvantages, it may simply be omitted.

Compositions in accordance with the present invention may be useful for inhibiting the onset or spread of white corrosion products, or the onset or spread of red rust, or both. The inhibition can be observed in the standard salt spray test of DIN No. 50021SS or ASTM B-117, which will be described further later. The inhibition of the onset of white corrosion products may be seen from the number of hours that a test sample can be subjected to the salt spray before white corrosion products appear and comparing this time with a control sample. The inhibition of spread of white corrosion products can be seen from the time taken for 30% of the surface of the test sample to be covered with white corrosion products. Correspondingly, the inhibition of the onset of red rust can be seen by the number of hours a test sample survives in the salt spray test before red rust appears, and the inhibition of the spread of red rust may be derived from the number of hours in the salt spray test before red rust covers 10% of the surface.

In some applications of passivation technology, it is important to prevent the onset or spread of white corrosion products. This may be particularly so in saline environments such as near the coast or on the roads when salt is used by gritting teams to melt surface ice. In other areas, preventing the onset and spread of white corrosion products is not as important as preventing the onset of red rust. For example, it is envisaged that passivated zinc-alloy plated dustbins could replace hot-dip galvanized bins, and the formation of white corrosion products on them would not necessarily be particularly serious or important.

Some of the compositions of the present invention are more effective at preventing the spread of white corrosion products or red rust than they are at preventing the onset of such corrosion. Similarly, some compositions give better protection against red rust than they do against white corrosion products. Such compositions are included within the invention, even though those giving better protection all round are in some or even most circumstances preferred.

The proportion of cobalt in the zinc-cobalt alloys which can be passivated by means of this invention can vary from 0.1 to 1.5 or 2% (w/w), although the effectiveness of the passivating compositings in inhibiting white corrosion products appears to fall off when the alloy contains more than about 1.0% cobalt. More generally, cost will tend to determine the upper limit of the cobalt content, as will the fact that it becomes difficult to obtain uniform alloy deposition when the cobalt content is above 2%.

According to a second aspect of the invention, there is provided a method of passivating a zinc-cobalt alloy, the method comprising contacting the alloy with an aqueous composition in accordance with the first aspect.

According to a third aspect of the invention, there is provided a passivated zinc-cobalt alloy, or material or an article having a zinc-cobalt alloy deposit, the alloy having been passivated by a process in accordance with the second aspect.

Preferred features of the second and third aspects are as for the first aspect *mutatis mutandis.*

For a better understanding of the present invention, and to show how it may be put into effect, the following examples and comparative examples are given, all of which were carried out on a zinc-cobalt coated steel test piece, the zinc-cobalt alloy coating of which contained 0.65% cobalt (unless otherwise stated) and was prepared according to a process which involves the use of a commercially available plating composition and which is described and claimed in No. GB-A-2116588, the disclosure of which is hereby incorporated by reference. Also unless otherwise stated, the thickness of the zinc-cobalt alloy coating was 10 microns.

In the following examples, chloride ions may be provided by salts of magnesium, ammonium, and group 1A metals such as sodium or potassium.

| Comparative Example A<br>A composition was made up as follows. | |
|---|---|
| Chromic acid | 5 g/l |
| Chloride ions | 2.8 g/l |
| Acid pH to 1.45 | |

The concentration of hexavalent chromium in the composition was 0.05M and the chloride concentration was 0.078M. A zinc-cobalt coated steel test piece, zinc-cobalt alloy of which contained 0.65% cobalt, was immersed in the composition at 25° C. for 25 seconds. A yellow passivate resulted. The passivated test piece was subjected to the standard salt spray test of DIN No. 50021SS or ASTM B-117, in which a 5% neutral salt spray is directed under controlled conditions at the test piece in order to determine the corrosion resistance. The longer a test piece survives in the spray without the formation of any white corrosion products or red rust, or without white corrosion products and red rust becoming firmly established, the better the corrosion resistance. The results are shown in Table 1.

| Comparative Example B<br>A composition was made up as follows. | |
|---|---|
| Chromic acid | 5 g/l |
| Sodium chloride | 5 g/l |
| Acid pH to 1.45 | |

The concentration of hexavalent chromium in the composition was 0.05M and the chloride concentration was 0.086M. A plated test piece, as used in Comparative Example A, was immersed in the composition at 25° C. for 25 seconds. It was then subjected to the neutral salt spray test. The results are shown in Table 1.

| Comparative Example C<br>A composition was made up as follows. | |
|---|---|
| Chromic acid | 5 g/l |
| Potassium chloride | 5 g/l |
| Acid pH to 1.45 | |

The concentration of hexavalent chromium in the composition was 0.05M and the chloride concentration was 0.067M. A plated test piece, as used in Comparative Example A, was immersed in the composition as 25° C. for 25 seconds. It was then subjected to the neutral salt spray test. The results are shown in Table 1.

TABLE 1

| Comparative | Hours neutral salt spray | | | |
|---|---|---|---|---|
| Example No. | Start wcp(1) | 30% wcp(1) | Start rr(2) | 10% rr(2) |
| A | 168 | 382–428 | 710–756 | 826 |
| B | 168 | 264–382 | 544–710 | 826 |

TABLE 1-continued

| Comparative Example No. | Hours neutral salt spray | | | |
|---|---|---|---|---|
| | Start wcp(1) | 30% wcp(1) | Start rr(2) | 10% rr(2) |
| C | 168 | 216 | 428–516 | 662 |

Notes
(1)white corrosion products
(2)red rust

EXAMPLE 1

A 1 liter composition was made up as follows.

| | |
|---|---|
| Chromic acid | 5 g/l |
| Chloride ions | 2.8 g/l |
| Sodium sulphate (anhydrous) | 1 g/l |
| Acid to pH 1.7 | |

In the above composition the concentration of hexavalent chromium was 0.05M, the chloride ion concentration was 0.078M and the sulphate ion concentration was 7 mM. A zinc-cobalt coated steel test piece was immersed in the composition at 25° C. for a sufficient time to obtain a good colour (35–45 seconds). The resulting passivated test piece was subjected to the standard neutral salt spray test. The results are shown in Table 2.

EXAMPLE 2

A 1 liter composition was made up as follows.

| | |
|---|---|
| Chromic acid | 5 g/l |
| Chloride ions | 2.8 g/l |
| Magnesium sulphate (heptahydrate) | 1.73 g/l |
| Acid pH to 1.7 | |

In the above composition the concentration of hexavalent chromium was 0.05M, the chloride ion concentration was 0.78M and the sulphate ion concentration was 7 mM. A zinc-cobalt coated steel test piece was immersed in the composition at 25° C. for a sufficient time to obtain a good colour (35–45 seconds). The resulting passivated test piece was subjected to the standard neutral salt spray test. The results are shown in Table 2.

EXAMPLE 3

A 1 liter composition was made up as follows.

| | |
|---|---|
| Chromic acid | 5 g/l |
| Chloride ions | 2.8 g/l |
| Nickel sulphate (hexahydrate) | 1.85 g/l |
| Acid to pH 1.7 | |

In the above composition the concentration of hexavalent chromium was 0.05M, the total chloride ion concentration was 0.078M, the sulphate ion concentration was 7 mM and the nickel ion concentration was 7 mM. A zinc-cobalt coated steel test piece was immersed in the composition at 25° C. for a sufficient time to obtain a good colour (35 to 45 seconds). The resulting passivated test piece was subjected to the standard neutral salt spray test. The results are shown in Table 2.

EXAMPLE 4

A 1 liter composition was made up as follows.

| | |
|---|---|
| Chromic acid | 5 g/l |
| Chloride ions | 2.8 g/l |
| Ammonium sulphate | 0.93 g/l |
| Acid to pH 1.7 | |

In the above composition the concentration of hexavalent chromium was 0.05M, the chloride ion concentration was 0.078M and the sulphate ion concentration was 7 mM. A zinc-cobalt coated steel test piece was immersed in the composition at 25° C. for a sufficient time to obtain a good colour (35 to 45 seconds). The resulting passivated test piece was subjected to the standard neutral salt spray test. The results are shown in Table 2.

EXAMPLE 5

A 1 liter composition was made up as follows.

| | |
|---|---|
| Chromic acid | 5 g/l |
| Chloride ions | 2.8 g/l |
| Nickel sulphate (hexahydrate) | 1 g/l |
| Acid to pH 1.45 | |

In the above composition the concentration of hexavalent chromium was 0.05M, the chloride ion concentration was 0.078M and the sulphate ion concentration was 3.8 mM. A zinc-cobalt coated steel test piece was immersed in the composition at 25° C. for 25 seconds. The resulting passivated test piece was subjected to the standard neutral salt spray test. The results are shown in Table 2.

EXAMPLE 6

A 1 liter composition was made up as follows.

| | |
|---|---|
| Chromic acid | 5 g/l |
| Chloride ions | 2.8 g/l |
| Nickel sulphate (hexahydrate) | 2 g/l |
| Acid to pH 1.45 | |

In the above composition the concentration of hexavalent chromium was 0.05M, the chloride ion concentration was 0.078M, the sulphate ion concentration was 7.6 mM and the nickel ion concentration was 7.6 mM. A zinc-cobalt coated steel test piece was immersed in the composition at 25° C. for 25 seconds. The resulting passivated test piece was subjected to the standard neutral salt spray test. The results are shown in Table 2.

EXAMPLE 7

A 1 liter composition was made up as follows.

| | |
|---|---|
| Chromic acid | 5 g/l |
| Chloride ions | 2.8 g/l |
| Nickel sulphate (hexahydrate) | 5 g/l |
| Acid to pH 1.4 | |

In the above composition the concentration of hexavalent chromium was 0.05M, the chloride ion concentration was 0.78M, the sulphate ion concentration was 19 mM and the nickel ion concentration was 19 mM. A zinc-cobalt coated steel test piece was immersed in the composition at 25° C. for 25 seconds. The resulting passivated test piece was subjected to the standard neutral salt spray test. The results are shown in Table 2.

EXAMPLE 8

A 1 liter composition was made up as follows.

| | |
|---|---|
| Chromic acid | 5 g/l |
| Chloride ions | 2.8 g/l |
| Cobalt sulphate (hexahydrate) | 1 g/l |
| Acid to pH 1.5 | |

In the above composition the concentration of hexavalent chromium was 0.05M, the chloride ion concentration was 0.78M, the sulphate ion concentration was 3.8 mM and the cobalt ion concentraton was 3.8 mM. A zinc-cobalt coated steel test piece was immersed in the composition at 25° C. for 25 seconds. The resulting passivated test piece was subjected to the standard neutral salt spray test. The results are shown in Table 2.

EXAMPLE 9

A 1 liter composition was made up as follows.

| | |
|---|---|
| Chromic acid | 5 g/l |
| Chloride ions | 2.8 g/l |
| Cobalt sulphate (hexahydrate) | 2 g/l |
| Acid to pH 1.45 | |

In the above composition the concentration of hexavalent chromium was 0.05M, the chloride ion concentration was 0.78M, the sulphate ion concentration was 7.6 mM and the cobalt ion concentration was 7.6 mM. A zinc-cobalt coated steel test piece was immersed in the composition at 25° C. for 25 seconds. The resulting passivated test piece was subjected to the standard neutral salt spray test. The results are shown in Table 2.

EXAMPLE 10

A 1 liter composition was made up as follows.

| | |
|---|---|
| Chromic acid | 5 g/l |
| Chloride ions | 2.8 g/l |
| Cobalt sulphate (hexahydrate) | 5 g/l |
| Acid to pH 1.45 | |

In the above composition the concentration of hexavalent chromium was 0.05M, the chloride ion concentration was 0.78M, the sulphate ion concentration was 19.0 mM and the cobalt ion concentration was 19.0 mM. A zinc-cobalt coated steel test piece was immersed in the composition at 25° C. for 25 seconds. The resulting passivated test piece was subjected to the standard neutral salt spray test. The results are shown in Table 2.

All the foregoing exemplified passivating solutions were artificially aged by adding 0.2 g/l zinc chloride in order to produce a small amount of trivalent chromium in the composition.

EXAMPLE 11

A passivated plated test piece was prepared as in Example 8, except that the thickness of the alloy deposit was 6 microns. In a different experimental location, the test piece was subjected to the ASTM B-117 neutral salt test. The results are shown in Table 2.

TABLE 2

| Example No. | Sulphate Addition | Hours neutral salt spray | | | |
|---|---|---|---|---|---|
| | | Start wcp(1) | 30% wcp(1) | Start rr(2) | 10% rr(2) |
| 1 | $Na_2SO_4$ (1 g/l) | 264–432 | 744–1032 | 984–>1200 | >1200 |
| 2 | $MgSO_4$ $7H_2O$ (1.73 g/l) | 336–480 | 744 | 912–1368 | 1320–1740 |
| 3 | $NiSO_4$ $6H_2O$ (1.85 g/l) | 168–480 | 696–1200 | 1482–1650 | 1954–2362 |
| 4 | $(NH_4)_2SO_4$ (0.93 g/l) | 336–480 | 648–1032 | 984–1482 | 1740–>2434 |
| 5 | $NiSO_4$ $6H_2O$ (1 g/l) | 96 | 428–516 | 1092–1164 | 1260–1424 |
| 6 | $NiSO_4$ $6H_2O$ (2 g/l) | 96 | 516 | 1260–1496 | 1880–>2000 |
| 7 | $NiSO_4$ $6H_2O$ (5 g/l) | 168 | 336–544 | 974–1092 | 1164–>2000 |
| 8 | $CoSO_4$ $6H_2O$ (1 g/l) | 96 | 516 | 1260–1332 | 1424–1928 |
| 9 | $CoSO_4$ $6H_2O$ (2 g/l) | 168 | 826 | 1092–1664 | >2000 |
| 10 | $CoSO_4$ $6H_2O$ (5 g/l) | 168 | 264 | 1044–1332 | 1260–>2000 |
| 11(3) | $CoSO_4$ $6H_2O$ (1 g/l ) | 166 | 312 | — | 840 |

Notes
(1)White corrosion products
(2)Red rust
(3)6 micron zinc-cobalt alloy deposit

EXAMPLE 12

A composition was made up as follows.

| | |
|---|---|
| Chromic acid | 4 g/l |
| Sodium chloride | 3.5 g/l |
| Cobalt sulphate (hexahydrate) | 1.5 g/l |
| Sodium formate | 5 g/l |
| Nitric acid (conc.) | 7.2 g/l |
| pH | 1.5 |

In the above composition the concentration of hexavalent chromium was 0.04M, the chloride concentration was 0.06M, the sulphate concentration was 5.7 mM and the concentration of cobalt was 5.7 mM.

A small test piece, barrel-plated to a thickness of 6 microns with a zinc-cobalt alloy whose cobalt content was 0.5%, was immersed in the composition at 25° C. for 30 seconds. A yellow-brass coloured passivate was obtained and the neutral salt spray test ASTM B-117 showed the passivate to be resistant for 245 hours before the onset of white corrosion products.

EXAMPLE 13

A composition was made up as follows.

| | |
|---|---|
| Chromic acid | 4 g/l |
| Ammonium chloride | 2 g/l |
| Sodium chloride | 1.5 g/l |
| Cobalt chloride (hexahydrate) | 1.25 g/l |
| pH | 1.4 |

In the above composition the concentration of hexavalent chromium was 0.04M, the chloride concentration was 0.07M and the cobalt concentration was 5.25 mM.

A bolt was plated with a zinc-cobalt alloy whose cobalt content was 0.7% to a thickness of 7.5 microns. The alloy plate was subsequently passivated by immersion in the above composition at 25° C. for 30 seconds. A bronze coloured passivate was obtained; the passivate provided excellent corrosion resistance of 264 hours to white corrosion under ASTM B-117.

The passivated alloy system provided 984–1208 hours protection under ASTM B-117 to 10% red rust at this particular alloy thickness; the degree of protection is dependent on the thickness of the alloy plate.

I claim:

1. A method of passivating a zinc-cobalt alloy wherein the cobalt may vary from 0.1 to 2% (w/w), the method comprising contacting the alloy with an aqueous composition comprising:

(i) a source of hexavalent chromium providing chromium (VI) ions from 0.01M to 1M;

(ii) hydrogen ions to provide an acid pH from 0.5 to 2.5;

(iii) a source of chloride ions from 0.01M to 0.5M; and (iv) an a source of sulphate ions providing sulphate ions from 2–20 mM . . . was inserted.

2. A method as claimed in claim 1, wherein the concentration of chromium (VI) is in the range of from 0.02M to 0.07M.

3. A method as claimed in claim 1, wherein the pH is in the range of from 1 to 2.

4. A method as claimed in claim 1, wherein the source of chloride ions is a Group Ia metal salt.

5. A method as claimed in claim 1, wherein the chloride concentration is in the range of from 0.02M to 0.2M.

6. A method as claimed in claim 1, wherein the source of sulphate ions is ammonium sulphate or a Group Ia metal sulphate.

7. A method as claimed in claim 1, wherein the composition includes nickel ions.

8. A method as claimed in claim 1, wherein the composition includes cobalt ions.

9. A method as claimed in claim 7, wherein the combined source of nickel ions and sulphate ions is nickel sulphate.

10. A method as claimed in claim 8, wherein the combined source of cobalt ions and sulphate ions is cobalt sulpate.

* * * * *